US010914124B2

(12) United States Patent
Borge

(10) Patent No.: US 10,914,124 B2
(45) Date of Patent: Feb. 9, 2021

(54) CUTTING ELEMENTS COMPRISING WAVEFORMS AND RELATED TOOLS AND METHODS

(71) Applicant: Baker Hughes, a GE company, LLC, Houston, TX (US)

(72) Inventor: Richard Wayne Borge, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 0 days.

(21) Appl. No.: 16/417,206

(22) Filed: May 20, 2019

(65) Prior Publication Data

US 2019/0309578 A1 Oct. 10, 2019

Related U.S. Application Data

(63) Continuation of application No. 15/584,943, filed on May 2, 2017, now Pat. No. 10,400,517.

(51) Int. Cl.
*E21B 10/567* (2006.01)
*E21B 10/46* (2006.01)
(Continued)

(52) U.S. Cl.
CPC ..... *E21B 10/5676* (2013.01); *C22C 26/00* (2013.01); *E21B 10/26* (2013.01);
(Continued)

(58) Field of Classification Search
CPC ..... E21B 10/46; E21B 10/5673; E21B 10/54; E21B 10/567; E21B 10/5671
See application file for complete search history.

(56) References Cited

U.S. PATENT DOCUMENTS 4,987,800 A * 1/1991 Gasan ..... B23P 15/28 175/428
4,989,578 A 2/1991 Lebourg
(Continued)

FOREIGN PATENT DOCUMENTS

EP 0572761 A1 * 12/1993 ..... E21B 10/5673
EP 0572761 A1 12/1993
(Continued)

OTHER PUBLICATIONS

International Written Opinion Application No. PCT/US2018/030590 dated Aug. 28, 2018, 8 pages.
(Continued)

*Primary Examiner* — Jennifer H Gay
(74) *Attorney, Agent, or Firm* — TraskBritt

(57) ABSTRACT

Cutting elements for earth-boring tools may include a polycrystalline, superabrasive material secured to an end of a substrate. The polycrystalline, superabrasive material may include a first transition surface and a second transition surface. A waveform may extend around a circumference of the second transition surface, a surface of the waveform tapered toward from the substrate and extending radially from the second transition surface toward the central axis. The surface of the waveform may extend from the second transition surface to a planar surface of the polycrystalline located at a same distance from the substrate as troughs of the waveform surface, the planar surface oriented perpendicular, and located proximate, to the central axis.

20 Claims, 8 Drawing Sheets

(51) Int. Cl.

| | |
|---|---|
| ***C22C 26/00*** | (2006.01) |
| ***E21B 10/26*** | (2006.01) |
| ***E21B 10/44*** | (2006.01) |
| *B22F 5/00* | (2006.01) |
| *B22F 7/06* | (2006.01) |
| *B22F 7/08* | (2006.01) |
| *C22C 29/10* | (2006.01) |
| *E21B 10/573* | (2006.01) |

(52) U.S. Cl.

CPC ..... *E21B 10/44* (2013.01); *E21B 10/46* (2013.01); *E21B 10/5673* (2013.01); *B22F 7/062* (2013.01); *B22F 7/08* (2013.01); *B22F 2005/001* (2013.01); *B22F 2999/00* (2013.01); *C22C 29/10* (2013.01); *E21B 10/573* (2013.01)

(56) References Cited

U.S. PATENT DOCUMENTS 5,054,246 A * 10/1991 Phaal ..... B24D 18/00 125/39
5,172,778 A * 12/1992 Tibbitts ..... E21B 10/5673 175/420.1
5,437,343 A * 8/1995 Cooley ..... E21B 10/5673 175/431
6,045,440 A 4/2000 Johnson et al.
6,065,554 A * 5/2000 Taylor ..... E21B 10/5735 175/430
6,196,340 B1 3/2001 Jensen et al.
6,244,365 B1 6/2001 Southland
6,510,910 B2 1/2003 Eyre et al.
6,527,069 B1 3/2003 Meiners et al.
6,550,556 B2 4/2003 Middlemiss et al.
6,929,079 B2 * 8/2005 McDonough ..... E21B 10/16 175/420.1
6,935,444 B2 * 8/2005 Lund ..... E21B 10/567 175/426
7,475,744 B2 * 1/2009 Pope ..... E21B 10/567 175/374
7,726,420 B2 6/2010 Shen et al.
7,740,090 B2 * 6/2010 Shen ..... E21B 10/573 175/426
8,037,951 B2 10/2011 Shen et al.
8,087,478 B2 * 1/2012 Patel ..... E21B 10/5673 175/57
8,499,860 B2 * 8/2013 Shen ..... E21B 10/567 175/374
8,684,112 B2 4/2014 Digiovanni et al.
9,062,505 B2 6/2015 Chapman et al.
9,103,174 B2 * 8/2015 DiGiovanni ..... E21B 10/55
9,145,743 B2 * 9/2015 Shen ..... E21B 10/567
9,243,452 B2 * 1/2016 DiGiovanni ..... B24D 18/00
9,376,867 B2 * 6/2016 DiGiovanni ..... B24C 1/04
9,388,639 B2 * 7/2016 Patel ..... E21B 10/42
9,404,310 B1 * 8/2016 Sani ..... E21B 10/567
9,428,966 B2 * 8/2016 Patel ..... E21B 10/5673
9,702,198 B1 * 7/2017 Topham ..... E21B 10/5673
9,845,642 B2 * 12/2017 Stockey ..... E21B 10/55
10,017,994 B2 * 7/2018 von Gynz-Rekowski ..... E21B 10/26
10,287,825 B2 * 5/2019 Chen ..... E21B 10/5673
10,400,517 B2 * 9/2019 Borge ..... E21B 10/5673
10,570,668 B2 * 2/2020 Izbinski ..... E21B 10/5735
10,577,870 B2 * 3/2020 Izbinski ..... E21B 10/567
2004/0163851 A1 * 8/2004 McDonough ..... E21B 10/16 175/374
2006/0157286 A1 * 7/2006 Pope ..... E21B 10/567 175/374
2006/0219439 A1 * 10/2006 Shen ..... E21B 10/573 175/57
2007/0079995 A1 4/2007 McClain et al.
2008/0205804 A1 8/2008 Jeng
2008/0236900 A1 * 10/2008 Cooley ..... E21B 10/573 175/432
2009/0057031 A1 3/2009 Patel et al.
2010/0084198 A1 4/2010 Durairajan et al.
2010/0288564 A1 11/2010 Dovalina et al.
2010/0307829 A1 * 12/2010 Patel ..... E21B 10/5673 175/57
2011/0031031 A1 2/2011 Vempati et al.
2011/0088950 A1 4/2011 Scott et al.
2011/0155472 A1 6/2011 Lyons et al.
2011/0259642 A1 10/2011 Digiovanni et al.
2012/0247834 A1 * 10/2012 Buxbaum ..... E21B 10/5673 175/57
2012/0325563 A1 12/2012 Scott et al.
2013/0068534 A1 * 3/2013 DiGiovanni ..... B24C 1/04 175/428
2013/0068537 A1 * 3/2013 DiGiovanni ..... E21B 10/5735 175/430
2013/0068538 A1 * 3/2013 DiGiovanni ..... B24D 18/00 175/432
2013/0292188 A1 * 11/2013 Bilen ..... E21B 10/5676 175/428
2013/0306377 A1 * 11/2013 DiGiovanni ..... B24C 1/04 175/65
2014/0041948 A1 * 2/2014 Shen ..... E21B 10/567 175/430
2014/0048340 A1 * 2/2014 DiGiovanni ..... B24C 1/04 175/430
2014/0238753 A1 8/2014 Nelms et al.
2014/0246253 A1 * 9/2014 Patel ..... E21B 10/5673 175/430
2014/0318873 A1 * 10/2014 Patel ..... E21B 10/5735 175/432
2015/0259986 A1 * 9/2015 Stockey ..... B24D 99/005 175/434
2015/0259988 A1 * 9/2015 Chen ..... E21B 10/5673 175/430
2016/0069140 A1 * 3/2016 Patel ..... 175/430
2016/0108678 A1 * 4/2016 von Gynz-Rekowski ..... E21B 6/02 175/57
2016/0265285 A1 * 9/2016 Stockey ..... E21B 10/5673
2017/0175452 A1 * 6/2017 Vempati ..... E21B 10/5673
2018/0320450 A1 * 11/2018 Borge ..... E21B 10/26
2019/0071933 A1 * 3/2019 Gan ..... E21B 10/5673
2019/0106943 A1 * 4/2019 Tilleman ..... E21B 10/43
2019/0112877 A1 * 4/2019 Gan ..... E21B 10/54
2019/0309578 A1 * 10/2019 Borge ..... E21B 10/44
2019/0376346 A1 * 12/2019 Vijayabalan ..... E21B 10/5673
2020/0032588 A1 * 1/2020 Izbinski ..... E21B 10/5673
2020/0032589 A1 * 1/2020 Izbinski ..... E21B 10/567

FOREIGN PATENT DOCUMENTS

GB 2369841 12/2004
WO 97/30263 A1 8/1997
WO WO-9730263 A1 * 8/1997 ..... E21B 10/5673
WO 00/48789 A1 8/2000
WO WO-0048789 A1 * 8/2000 ..... B23P 15/28
WO 2004/007901 A1 1/2004
WO 2004/007907 A1 1/2004
WO 2008/102324 A1 8/2008
WO 2016/004136 A1 3/2016
WO 2016/044136 A1 3/2016

OTHER PUBLICATIONS

International Search Report for Application No. PCT/US2018/030590 dated Aug. 28, 2018, 3 pages.

* cited by examiner

CUTTING ELEMENTS COMPRISING WAVEFORMS AND RELATED TOOLS AND METHODS

CROSS-REFERENCE TO RELATED APPLICATION

This application is a continuation of U.S. patent application Ser. No. 15/584,943, filed May 2, 2017, now U.S. Pat. No. 10,400,517, issued Sep. 3, 2019, the disclosure of which is incorporated herein in its entirety by this reference.

FIELD

This disclosure relates generally to cutting elements for earth-boring tools, to earth-boring tools carrying such cutting elements, and to related methods. More specifically, disclosed embodiments relate to cutting elements for earth-boring tools that may better resist impact damage, induce beneficial stress states within the cutting elements, and improve cooling of the cutting elements.

BACKGROUND

Some earth-boring tools for forming boreholes in subterranean formations, such as, for example, fixed-cutter earth-boring rotary drill bits (also referred to as "drag bits") and reamers, include cutting elements comprising superabrasive, conventionally polycrystalline diamond compact (PDC) cutting tables mounted to supporting substrates and secured to the rotationally leading portions of blades. The cutting elements are conventionally fixed in place, such as, for example, by brazing the cutting elements within pockets formed in the rotationally leading portions of the blades. Because formation material removal exposes the formation-engaging portions of the cutting tables to impacts against the subterranean formations, they may chip, which dulls the impacted portion of the cutting element or even spall, resulting in loss of substantial portions of the table. Continued use may wear away that portion of the cutting table entirely, leaving a completely dull surface that is ineffective at removing earth material.

BRIEF SUMMARY

In some embodiments, cutting elements for earth-boring tools may include a substrate and a polycrystalline, superabrasive material secured to an end of the substrate. The polycrystalline, superabrasive material may include a first transition surface extending in a direction oblique to a central axis of the substrate, a second transition surface extending in a second direction oblique to the central axis, the second direction being different from the first direction, and a curved, stress-reduction feature located on the second transition surface.

In other embodiments, earth-boring tools may include a body and a cutting element secured to the body. The cutting element may include a substrate and a polycrystalline, superabrasive material secured to an end of the substrate. The polycrystalline, superabrasive material may include a first transition surface extending in a direction oblique to a central axis of the substrate, a second transition surface extending in a second direction oblique to the central axis, the second direction being different from the first direction, and a curved, stress-reduction feature located on the second transition surface.

In still other embodiments, methods of making cutting elements for earth-boring tools may involve shaping a polycrystalline, superabrasive material to include: a first transition surface extending in a direction oblique to a central axis of the substrate; a second transition surface extending in a second direction oblique to the central axis, the second direction being different from the first direction; and a curved, stress-reduction feature located on the second transition surface. The polycrystalline, superabrasive material may be secured to a substrate.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular cutting element, earth-boring tool, or component thereof, but are merely idealized representations employed to describe illustrative embodiments. Thus, the drawings are not necessarily to scale.

Disclosed embodiments relate generally to cutting elements for earth-boring tools that may better resist impact damage, induce beneficial stress states within the cutting elements, and improve cooling of the cutting elements. More specifically, disclosed are embodiments of cutting elements that may include multiple transition surfaces proximate a periphery of the cutting elements, at least one curved, stress-reduction feature located on one or more of the transition surfaces, and an optional recess extending from a radially innermost transition surface back toward a substrate of the respective cutting element.

The term "earth-boring tool," as used herein, means and includes any type of bit or tool used for drilling during the formation or enlargement of a wellbore in a subterranean formation. For example, earth-boring tools include fixed-cutter bits, roller cone bits, percussion bits, core bits, eccentric bits, bicenter bits, reamers, mills, drag bits, hybrid bits, and other drilling bits and tools known in the art.

As used herein, the term "superabrasive material" means and includes any material having a Knoop hardness value of about 3,000 Kgf/mm$^2$ (29,420 MPa) or more. Superabrasive materials include, for example, diamond and cubic boron nitride. Superabrasive materials may also be characterized as "superhard" materials.

As used herein, the term "polycrystalline material" means and includes any structure comprising a plurality of grains (i.e., crystals) of material that are bonded directly together by inter-granular bonds. The crystal structures of the individual grains of the material may be randomly oriented in space within the polycrystalline material.

As used herein, the terms "inter-granular bond" and "interbonded" mean and include any direct atomic bond (e.g., covalent, metallic, etc.) between atoms in adjacent grains of superabrasive material.

The term "sintering," as used herein, means temperature driven mass transport, which may include densification and/or coarsening of a particulate component. For example, sintering typically involves shrinkage and removal of at least some of the pores between the starting particles, accompanied by part shrinkage, combined with coalescence and bonding between adjacent particles.

As used herein, the term "tungsten carbide" means any material composition that contains chemical compounds of tungsten and carbon, such as, for example, WC, $W_2C$, and combinations of WC and $W_2C$. Tungsten carbide includes, for example, cast tungsten carbide, sintered tungsten carbide, and macrocrystalline tungsten carbide.

Figure 1:
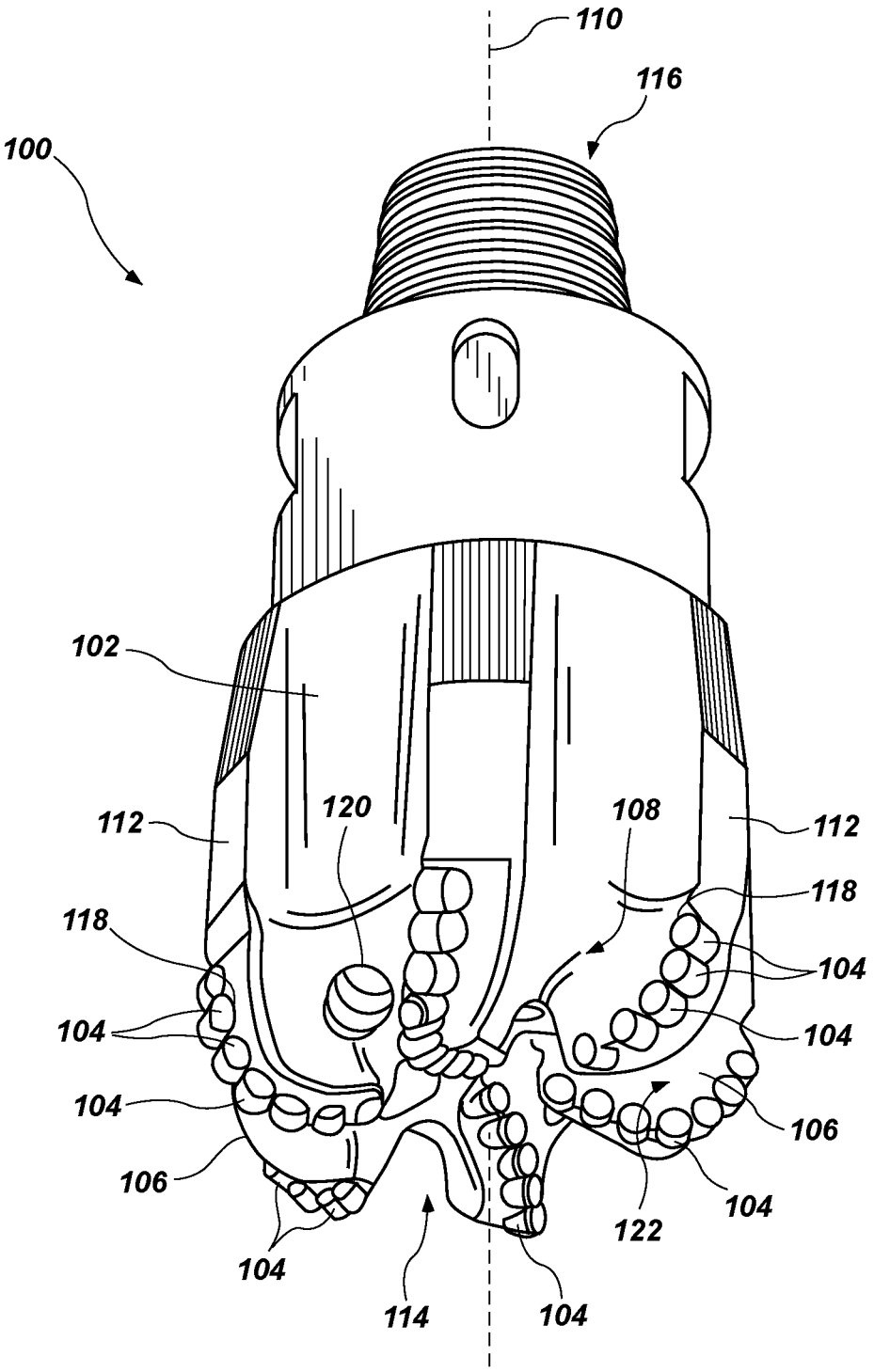
FIG. 1 is a perspective view of an earth-boring tool.

Referring to FIG. 1, a perspective view of an earth-boring tool 100 is shown. The earth-boring tool 100 may include a body 102 having cutting elements 104 secured to the body 102. The earth-boring tool 100 shown in FIG. 1 may be configured as a fixed-cutter drill bit, but other earth-boring tools having cutting elements 104 secured to a body may be employed, such as, for example, those discussed previously in connection with the term "earth-boring tool." The earth-boring tool 100 may include blades 106 extending outward from a remainder of the body 102, with junk slots 108 being located rotationally between adjacent blades 106. The blades 106 may extend radially from proximate an axis of rotation 110 of the earth-boring tool 100 to a gage region 112 at a periphery of the earth-boring tool 100. The blades 106 may extend longitudinally from a face 114 at a leading end of the earth-boring tool 100 to the gage region 112 at the periphery of the earth-boring tool 100. The earth-boring tool 100 may include a shank 116 at a trailing end of the earth-boring tool 100 longitudinally opposite the face 114. The shank 116 may have a threaded connection portion, which may conform to industry standards (e.g., those promulgated by the American Petroleum Institute (API)), for attaching the earth-boring tool 100 to a drill string.

The cutting elements 104 may be secured within pockets 118 formed in the blades 106. Nozzles 120 located in the junk slots 108 may direct drilling fluid circulating through the drill string toward the cutting elements 104 to cool the cutting elements 104 and remove cuttings of earth material. The cutting elements 104 may be positioned to contact, and remove, an underlying earth formation in response to rotation of the earth-boring tool 100 when weight is applied to the earth-boring tool 100. For example, cutting elements 104 in accordance with this disclosure may be primary or secondary cutting elements (i.e., may be the first or second surface to contact an underlying earth formation in a given cutting path), and may be located proximate a the rotationally leading surface 122 of a respective blade 106 or may be secured to the respective blade 106 in a position rotationally trailing the rotationally leading surface 122.

Figure 2:
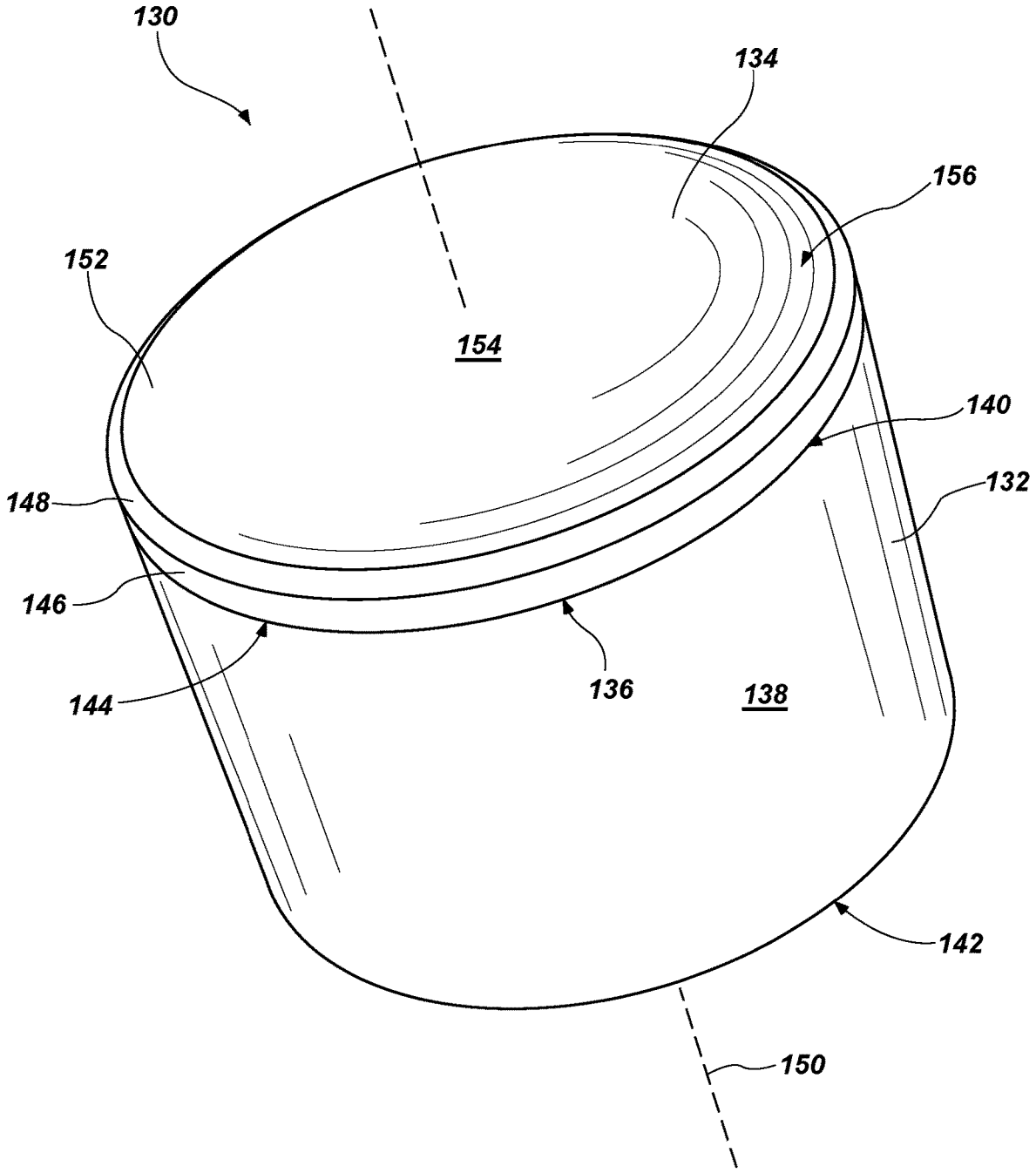
FIG. 2 is a perspective view of an embodiment of a cutting element usable with the earth-boring tool of FIG. 1.

FIG. 2 is a perspective view of an embodiment of a cutting element 130 usable with the earth-boring tool 100 of FIG. 1. The cutting element 130 may include a substrate 132 and a table of polycrystalline, superabrasive material 134 secured to an end 136 of the substrate 132. More specifically, the polycrystalline, superabrasive material 134 may be a polycrystalline diamond compact (PDC). The substrate 132 may be generally cylindrical in shape. For example, the substrate 132 may include a curved side surface 138 extending around a periphery of the substrate 132 and end surfaces 140 and 142. The end surfaces 140 and 142 may have a circular or oval shape, for example. The end surfaces 140 and 142 may be, for example, planar or nonplanar. For example, the end surface 140 forming an interface between the substrate 132 and the polycrystalline, superabrasive material 134 may be nonplanar. In some embodiments, the substrate 132 may include a chamfer transitioning between the side surface 138 and one or more of the end surfaces 140 and 142, typically between side surface 138 and end surface 142. The substrate 132 may have a central axis 150 extending parallel to the side surface 138 through geometric centers of the end surfaces 140 and 142. The substrate 132 may include hard, wear-resistant materials suitable for use in a downhole drilling environment. For example, the substrate 132 may include metal, metal alloys, ceramic, and/or metal-ceramic composite (i.e., "cermet") materials. As a specific, nonlimiting example, the substrate 132 may include a cermet including particles of tungsten carbide cemented in a metal or metal alloy matrix.

The polycrystalline, superabrasive material 134 may include an interfacial surface 144 abutting, and secured to, the end surface 140 of the substrate 132. The polycrystalline, superabrasive material 134 may be generally disc-shaped, and may include a side surface 146 extending longitudinally from the interfacial surface 144 away from the substrate 132. The side surface 146 may be curved, and may be, for example, flush with the side surface 138 of the substrate 132.

The polycrystalline, superabrasive material 134 may include a first transition surface 148 extending from the side surface 146 away from the substrate 132. The first transition surface 148 may have a frustoconical shape, and may comprise what is often referred to in the art as a "chamfer" surface. The first transition surface 148 may extend away from the substrate 132 in a first direction oblique to the central axis 150 of the substrate 132. The first transition surface 148 may extend radially from the side surface 146 at the periphery of the polycrystalline, superabrasive material 134 inward toward the central axis 150. In some embodiments, the polycrystalline, superabrasive material 134 may lack the side surface 146, such that the first transition surface 148 may begin at an intersection (e.g., an edge) with the interfacial surface 144 located adjacent to the end surface 140 of the substrate 132.

The polycrystalline, superabrasive material 134 may further include a second transition surface 152 extending from the first transition surface 148 away from the substrate 132. The second transition surface 152 may extend away from the substrate 132 in a second direction oblique to the central axis 150 of the substrate 132. The second direction in which the second transition surface 152 extends may be different from the first direction in which the first transition surface 148 extends. The second transition surface 152 may extend radially from the first transition surface 148 at the radially innermost extent thereof inward toward the central axis 150. For example, the second transition surface 152 may extend radially inward more rapidly than the first transition surface 148.

In some embodiments, such as that shown in FIG. 2, the polycrystalline, superabrasive material 134 may include a cutting face 154 extending from the second transition surface 152 radially inward to the central axis 150. The cutting face 154 may extend, for example, in a direction perpendicular to the central axis 150. Each of the first transition surface 148, the second transition surface 152, and the cutting face 154 may have a cross-sectional shape at least substantially similar to, though smaller in a radial extent than, a cross-sectional shape of the side surfaces 138 and 146 of the substrate 132 and the polycrystalline, superabrasive material 134. In some embodiments, the cutting face 154 may exhibit a different degree of roughness than a remainder of the exposed surfaces of the polycrystalline, superabrasive material 134. For example, the cutting face 154 may be rougher than (e.g., may be polished to a lesser degree or with a less fine polish) the remainder of the exposed surfaces of the polycrystalline, superabrasive material 134. More specifically, a difference in surface roughness between the cutting face 154 and the remainder of the exposed surfaces of the polycrystalline, superabrasive material 134 may be, for example, between about 1 μin Ra and about 30 μin Ra. Ra may be defined as the arithmetic average of the absolute values of profile height deviations from the mean line, recorded within an evaluation length. Stated another way, Ra is the average of a set of individual measurements of a surface's peaks and valleys. As a specific, nonlimiting example, the difference in surface roughness between the cutting face 154 and the remainder of the exposed surfaces of the polycrystalline, superabrasive material 134 may be between about 20 μin Ra and about 25 μin Ra. As continuing examples, a surface roughness of the cutting face 154 may be between about 20 μin Ra and about 40 μin Ra, and a surface roughness of the remainder of the exposed surface of the polycrystalline, superabrasive material 134 may be between about 1 μin Ra and about 10 μin Ra. More specifically, the surface roughness of the cutting face 154 may be, for example, between about 20 μin Ra and about 30 μin Ra, and the surface roughness of the remainder of the exposed surface of the polycrystalline, superabrasive material 134 may be, for example, between about 1 μin Ra and about 7 μin Ra. As specific, nonlimiting examples, a surface roughness of the cutting face 154 may be between about 22 μin Ra and about 27 μin Ra (e.g., about 25 μin Ra), and a surface roughness of the remainder of the exposed surface of the polycrystalline, superabrasive material 134 may be between about 1 μin Ra and about 5 μin Ra (e.g., about 1 μin Ra). The change in direction from the second transition surface 152 to the cutting face 154, and the optional change in roughness in certain embodiments, may cause cuttings produced by the cutting element 130 to break off, acting as a chip breaker.

By increasing the number of transition surfaces relative to a cutting element with a single chamfer, the cutting element 130 may increase the time over which an impulse resulting from contact with an earth formation may act on the cutting element. As a result, the cutting element 130 may reduce peak collision force, reducing impact and chip damage and increasing the useful life of the cutting element 130.

The cutting element 130 may further include a curved, stress-reduction feature 156 located on the second transition surface 152. The curved, stress-reduction feature 156 may be sized and shaped to induce a beneficial stress state within the polycrystalline, superabrasive material 134. More specifically, the curved stress-reduction feature 156 may reduce the likelihood that tensile stresses will occur, and may reduce the magnitude of any tensile stresses that appear, in the polycrystalline, superabrasive material 134. As shown in FIG. 2, the curved, stress-reduction feature 156 may be a radiusing of the second transition surface 152 itself in some embodiments.

Figure 3:
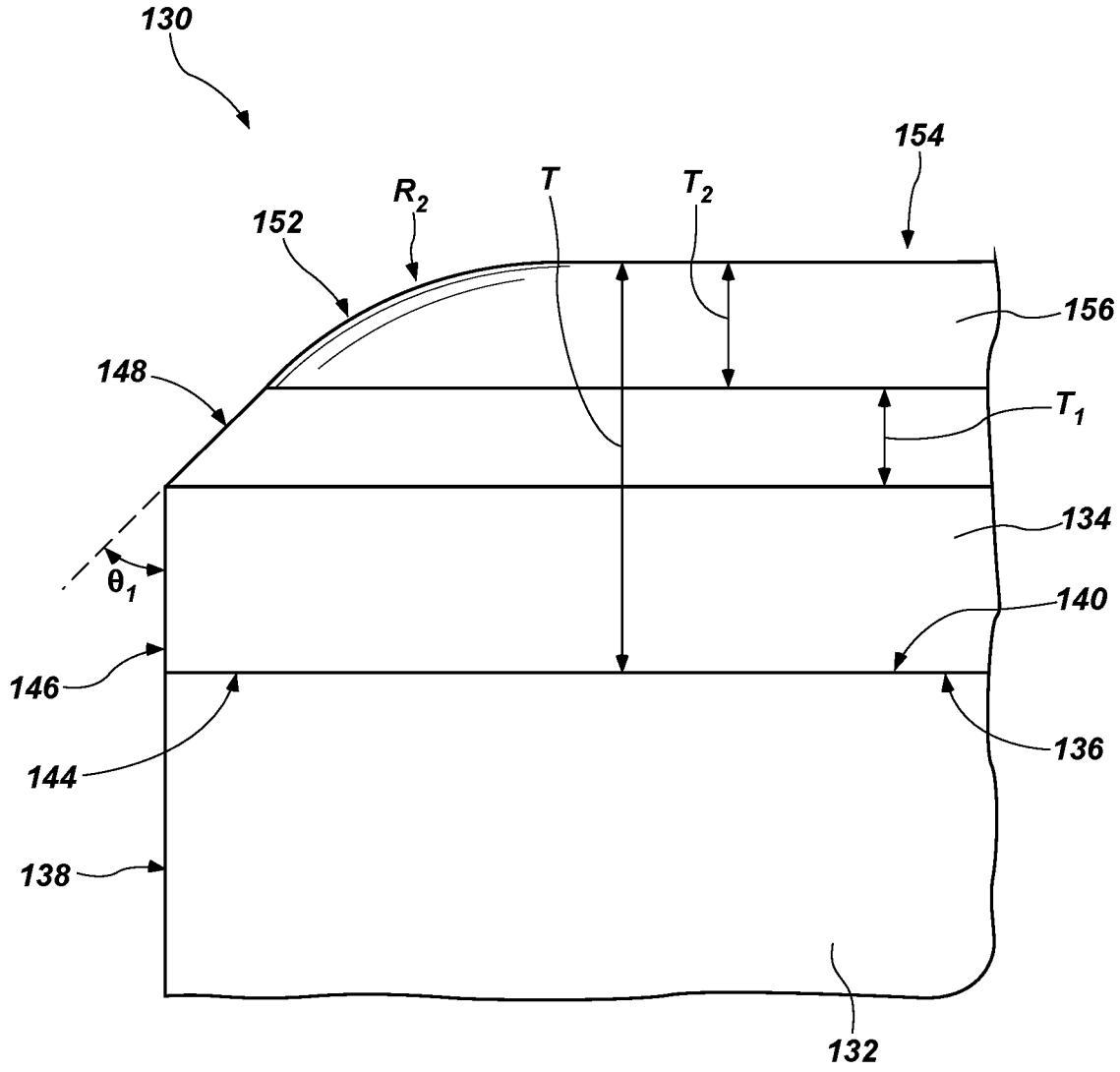
FIG. 3 is a side view of a portion of the cutting element of FIG. 2.

FIG. 3 is a side view of a portion of the cutting element 130 of FIG. 2. As shown in FIGS. 2 and 3, the first transition surface 148 may be a chamfered surface in some embodiments. For example, the first transition surface 148 may extend at a constant slope from the side surface 146 toward the central axis 150 (see FIG. 2). More specifically, a first acute angle $\theta_1$ between the first transition surface 148 and the central axis 150 (see FIG. 2) may be, for example, between about 30° and about 60°. As a specific, nonlimiting example, the first acute angle $\theta_1$ between the first transition surface 148 and the central axis 150 (see FIG. 2) may be between about 40° and about 50° (e.g., about 45°). A first thickness $T_1$ of the first transition surface 148 as measured in a direction parallel to the central axis 150 (see FIG. 2) may be, for example, between about 5% and about 20% of a total thickness T of the polycrystalline, superabrasive material 134 as measured in the same direction. More specifically, the first thickness $T_1$ of the first transition surface 148 may be, for example, between about 7% and about 15% of the total thickness T of the polycrystalline, superabrasive material 134. As a specific, nonlimiting example, the first thickness $T_1$ of the first transition surface 148 may be between about 8% and about 12% (e.g., about 10%) of the total thickness T of the polycrystalline, superabrasive material 134. The first thickness $T_1$ of the first transition surface 148 may be, as another example, between about 0.014 inch and about 0.018 inch. More specifically, the first thickness $T_1$ of the first transition surface 148 may be, for example, between about 0.015 inch and about 0.017 inch. As a specific, nonlimiting example, the first thickness $T_1$ of the first transition surface 148 may be about 0.016 inch.

The second transition surface 152 may be a truncated dome shape in some embodiments, such as that shown in FIGS. 2 and 3. For example, a slope of the second transition surface 152 may change at least substantially continuously, and at an at least substantially constant rate, from the first transition surface 148 to the cutting face 154. More specifically, a radius of curvature $R_2$ of the second transition surface 152 may be, for example, between about 0.02 inch and about 0.13 inch. As a specific, nonlimiting example, the radius of curvature $R_2$ of the second transition surface 152 may be, for example, between about 0.06 inch and about 0.1 inch (e.g., about 0.08 inch). A second thickness $T_2$ of the second transition surface 152 as measured in a direction parallel to the central axis 150 (see FIG. 2) may be greater than the first thickness $T_1$ of the first transition surface 148 and may be, for example, between about 5% and about 50% of the total thickness T of the polycrystalline, superabrasive material 134 as measured in the same direction. More specifically, the second thickness $T_2$ of the second transition surface 152 may be, for example, between about 15% and about 45% of the total thickness T of the polycrystalline, superabrasive material 134. As a specific, nonlimiting example, the second thickness $T_2$ of the second transition surface 152 may be between about 20% and about 35% (e.g., about 30%) of the total thickness T of the polycrystalline, superabrasive material 134. The second thickness $T_2$ of the second transition surface 152 may be, as another example, between about 0.01 inch and about 0.05 inch. More specifically, the second thickness $T_2$ of the second transition surface 152 may be, for example, between about 0.02 inch and about 0.04 inch. As a specific, nonlimiting example, the second thickness $T_2$ of the second transition surface 152 may be about 0.03 inch.

Figure 4:
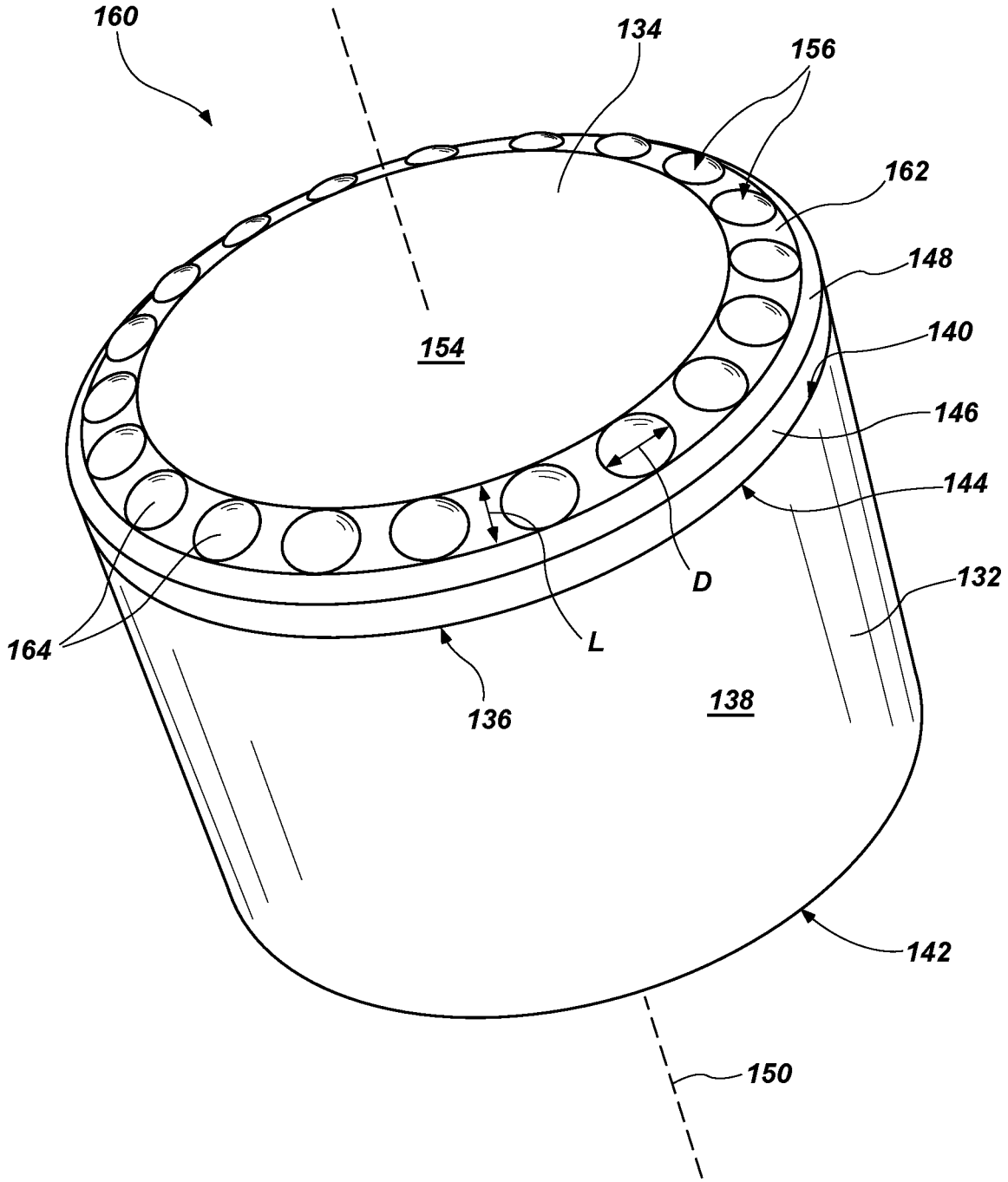
FIG. 4 is a perspective view of another embodiment of a cutting element usable with the earth-boring tool of FIG. 1.

FIG. 4 is a perspective view of another embodiment of a cutting element 160 usable with the earth-boring tool 100 of FIG. 1. In some embodiments, such as that shown in FIG. 4, a second transition surface 162 may not curve as it extends from the first transition surface 148 to the cutting face 154. For example, a slope of the second transition surface 162 may be constant as it extends in a direction oblique to the central axis 150 from the side surface 146 to the cutting face 154.

As shown in FIG. 4, the curved, stress-reduction feature 156 may include a pattern of bumps 164 located on, and protruding from, the second transition surface 162. A perimeter of the bumps 164 may be of any shape, such as, for example, circular, triangular, quadrilateral, etc. As a specific, nonlimiting example, the perimeter of a given bump 164 shown in FIG. 4 as viewed in a plane tangent to the second transition surface 152 at a geometric center of the given bump 164 may be generally circular. Each bump 164 may bulge outward from the second transition surface 152, and may be arcuate in shape as it extends away from the second transition surface 152. A maximum distance D between points at a periphery of a given bump 164 may be, for example, between about 90% and about 100% of a minimum length L of the second transition surface 152 measured between its intersection with the side surface 146 or the interfacial surface 144 and the cutting face 154. More specifically, the maximum distance D between points at the periphery of a given bump 164 may be, for example, between about 95% and about 100% of the minimum length L of the second transition surface 152 measured between its intersection with the side surface 146 or the interfacial surface 144 and the cutting face 154. As a specific, nonlimiting example, the maximum distance D between points at the periphery of a given bump 164 may be about 100% of the minimum length L of the second transition surface 152 measured between its intersection with the side surface 146 or the interfacial surface 144 and the cutting face 154. The maximum distance D between points at the periphery of a given bump 164 may be, for example, between about 0.001 inch and about 0.02 inch. More specifically, the maximum distance D between points at the periphery of a given bump 164 may be, for example, between about 0.005 inch and about 0.015 inch. As a specific, nonlimiting example, the maximum distance D between points at the periphery of a given bump 164 may be between about 0.008 inch and about 0.012 inch (e.g., about 0.01 inch).

A frequency at which the bumps 164 may be positioned around the second transition surface 152 may be, for example, between about one every 90° and about ten every 90°. More specifically, the frequency at which the bumps 164 may be positioned around the second transition surface 152 may be, for example, between about two every 90° and about eight every 90°. As a specific, nonlimiting example, the frequency at which the bumps 164 may be positioned around the second transition surface 152 may be, for example, between about three every 90° and about seven every 90° (e.g., about five every 90°). A total number of bumps 164 located around the circumference of the second transition surface 152 may be, for example, between about four and about 40. More specifically, the total number of bumps 164 located around the circumference of the second transition surface 152 may be, for example, between about eight and about 32. As a specific, nonlimiting example, the total number of bumps 164 located around the circumference of the second transition surface 152 may be, for example, between about 12 and about 28 (e.g., about 20).

Figure 5:
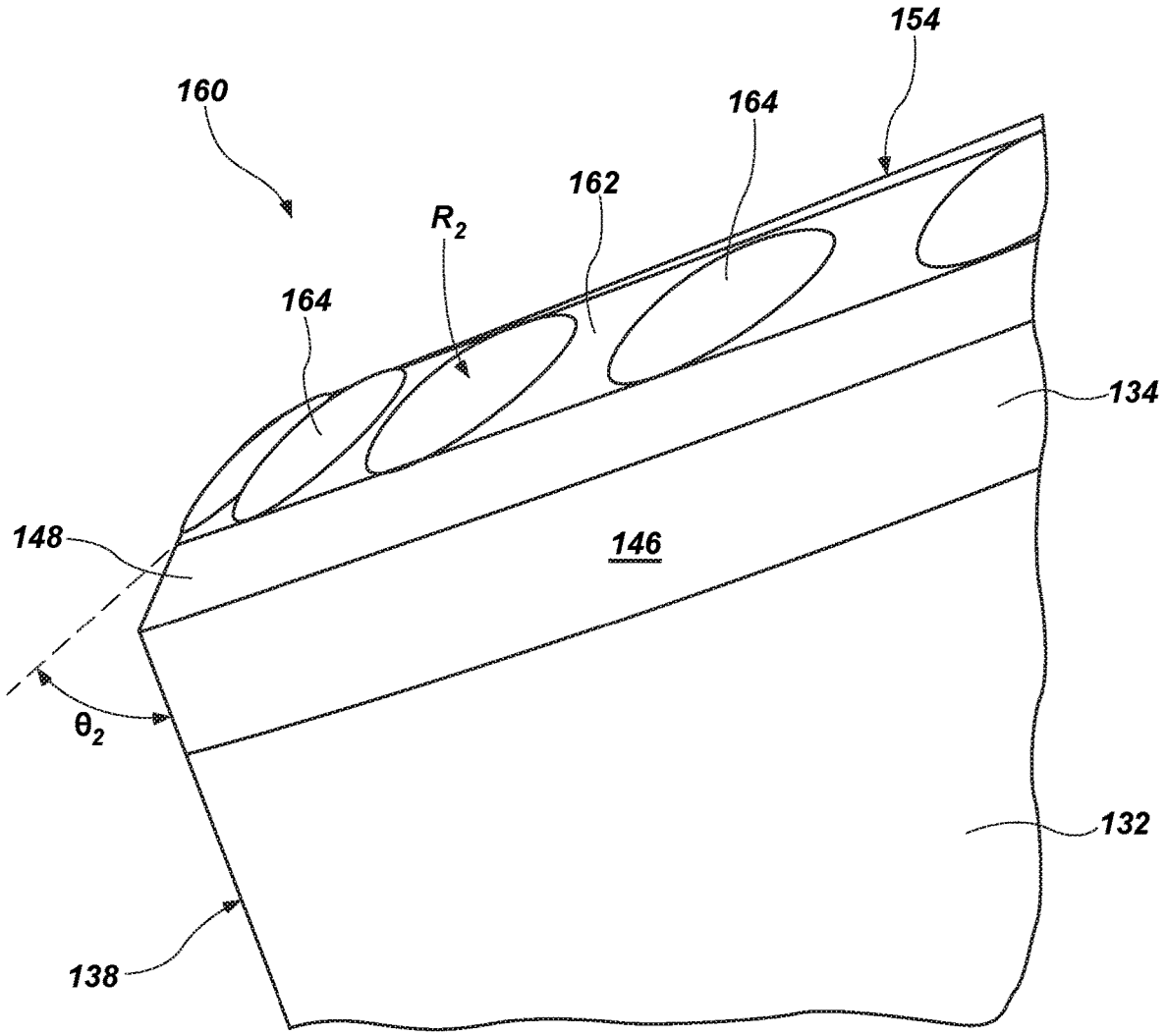
FIG. 5 is a close-up perspective view of a portion of the cutting element of FIG. 4.

FIG. 5 is a close-up perspective view of a portion of the cutting element 160 of FIG. 4. As shown in FIGS. 4 and 5, the second transition surface 152 may be a chamfered surface in some embodiments. For example, the second transition surface 152 may extend at a constant slope from the side surface 146 toward the central axis 150 (see FIG. 4). More specifically, a second acute angle $\theta_2$ between the second transition surface 152 and the central axis 150 (see FIG. 4) may be, for example, between about 30° and about 89°. As a specific, nonlimiting example, the first acute angle $\theta_1$ between the first transition surface 148 and the central axis 150 (see FIG. 2) may be between about 50° and about 70° (e.g., about 60°).

A radius of curvature $R_2$ of an outer surface of the bumps 164 may be, for example, between about 0.02 inch and about 0.13 inch. More specifically, the radius of curvature $R_2$ of an outer surface of the bumps 164 may be, for example, between about 0.06 inch and about 0.1 inch. As a specific, nonlimiting example, the radius of curvature $R_2$ of an outer surface of the bumps 164 may be, for example, about 0.08 inch. In some embodiments, each bump 164 may have the same radius of curvature R. In other embodiments, at least one bump 164 may have a different radius of curvature R from a radius of curvature of at least one other bump 164.

Figure 6:
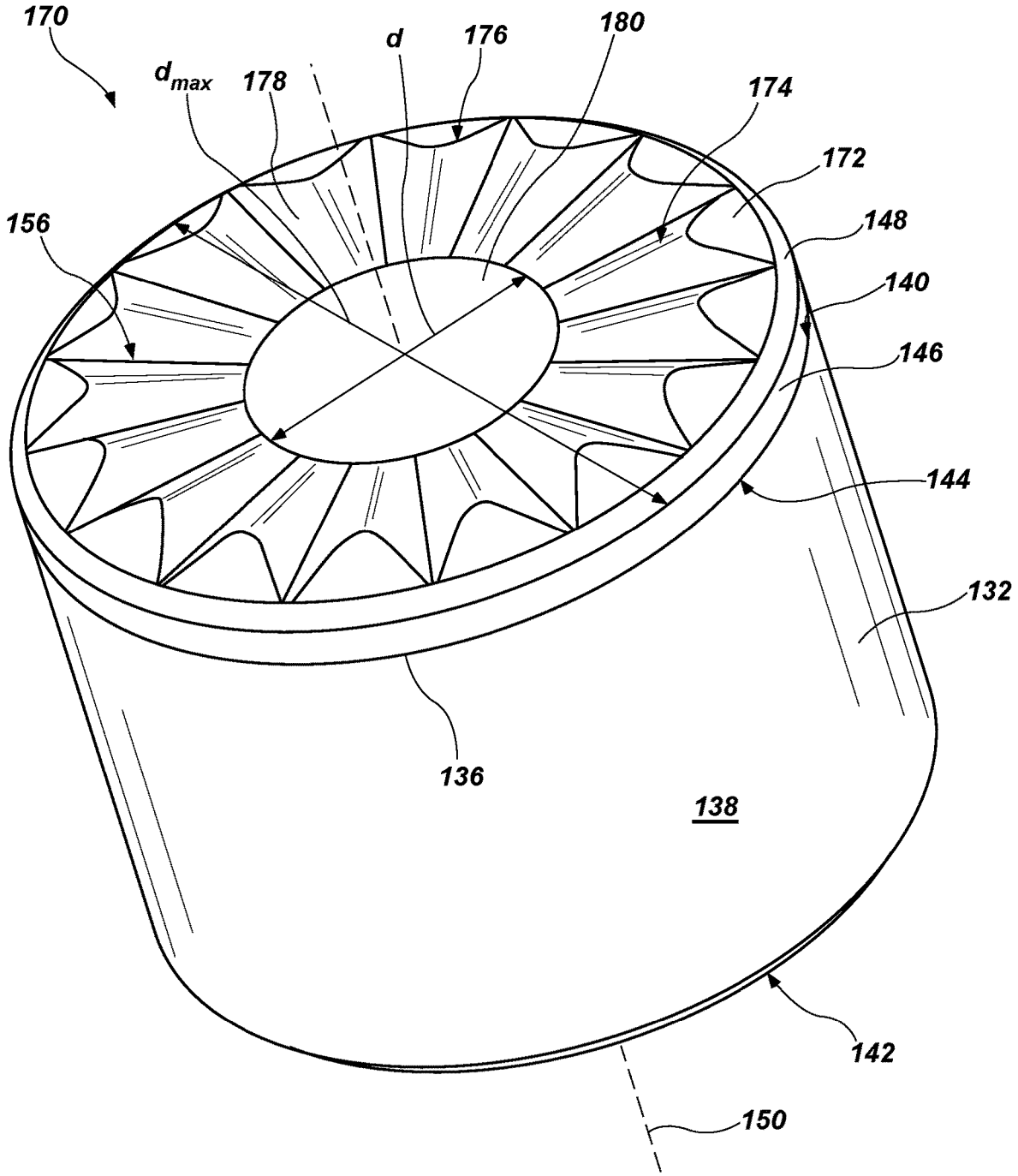
FIG. 6 is a perspective view of yet another embodiment of a cutting element usable with the earth-boring tool of FIG. 1.

FIG. 6 is a perspective view of yet another embodiment of a cutting element 170 usable with the earth-boring tool 100 of FIG. 1. As shown in FIG. 6, the curved, stress-reduction feature 156 may include a waveform 174 formed in a second transition surface 172. More specifically, the second transition surface 172 may extend from the first transition surface 148 to an undulating edge 176 at a longitudinally uppermost extent of the second transition surface 172 farthest from the substrate 132. The undulating edge 176 may exhibit, for example, a sinusoidal shape. A surface 178 of the waveform 174 may extend from the undulating edge 176 radially inward toward the central axis 150. The surface 178 of the waveform 174 may also extend longitudinally from the undulating edge 176 toward the substrate 132, such that the surface 178 extends in a third direction oblique to the central axis 150. More specifically, the troughs of the waveform 174 may extend in a radial direction perpendicular to the central axis 150, and the peaks of the waveform 174 may extend in a radial direction oblique to the central axis 150, such that the height of the peaks decreases as radial distance from the central axis 150 decreases. In addition to inducing beneficial stress states within the cutting element 170, the waveform 174 may increase fluid flow across the polycrystalline, superabrasive material 134, improving cooling and facilitating removal of cuttings.

The surface 178 of the waveform 174 may intersect with a planar surface 180 extending perpendicular to, and intersected by, the central axis 150. The planar surface 180 may be located, for example, in the same position along the longitudinal axis 150 as the edge defined at the intersection between the first transition surface 148 and the second transition surface 172. A diameter d of the planar surface 180 may be, for example, between about 10% and about 50% of a maximum diameter $d_{max}$ of the polycrystalline, superabrasive material 134. More specifically, the diameter d of the planar surface 180 may be, for example, between about 20% and about 40% of the maximum diameter $d_{max}$ of the polycrystalline, superabrasive material 134. As a specific, nonlimiting example, the diameter d of the planar surface 180 may be, for example, between about 25% and about 35% (e.g., about 30%) of the maximum diameter $d_{max}$ of the polycrystalline, superabrasive material 134. In some embodiments, the planar surface 180 may exhibit a different degree of roughness than a remainder of the exposed surfaces of the polycrystalline, superabrasive material 134. For example, the planar surface 180 may be rougher than (e.g., may be polished to a lesser degree or with a less fine polish) the remainder of the exposed surfaces of the polycrystalline, superabrasive material 134. The change in direction from the surface 178 of the waveform 174 to the planar surface 180, and the optional change in roughness in certain embodiments, may cause cuttings produced by the cutting element 170 to break off, acting as a chip breaker.

A frequency of the waveform 174 may be, for example, between about one peak every 180° and about ten peaks every 90°. More specifically, the frequency of the waveform 174 may be, for example, between about two peaks every 90° and about eight peaks every 90°. As a specific, nonlimiting example, the frequency of the waveform 174 may be, for example, between about three peaks every 90° and about seven peaks every 90° (e.g., about five peaks every 90°).

In embodiments where the cutting element 170 includes a waveform 174, such as that shown in FIG. 6, the first portion of the cutting element 170 to contact an underlying earth formation may be the peak or peaks of the waveform 174 that are being forced into the earth formation by applied weight on the earth-boring tool 100 (see FIG. 1). As a result, the surface area that initially contacts the earth formation may be reduced, which may increase the stress induced in the earth formation to better initiate and propagate cracks therein.

Various features of the cutting elements shown in FIGS. 2 through 6 may be combined with one another. For example, cutting elements in accordance with this disclosure may include the curved second transition surface 152 of FIGS. 2 and 3 in combination with the bumps 164 of FIGS. 4 and 5, the waveform 174 of FIG. 6, or both. As another example, cutting elements in accordance with this disclosure may include the bumps 164 of FIGS. 4 and 5 in combination with the curved second transition surface 152 of FIGS. 2 and 3, the waveform 174 of FIG. 6, or both.

Figure 7:
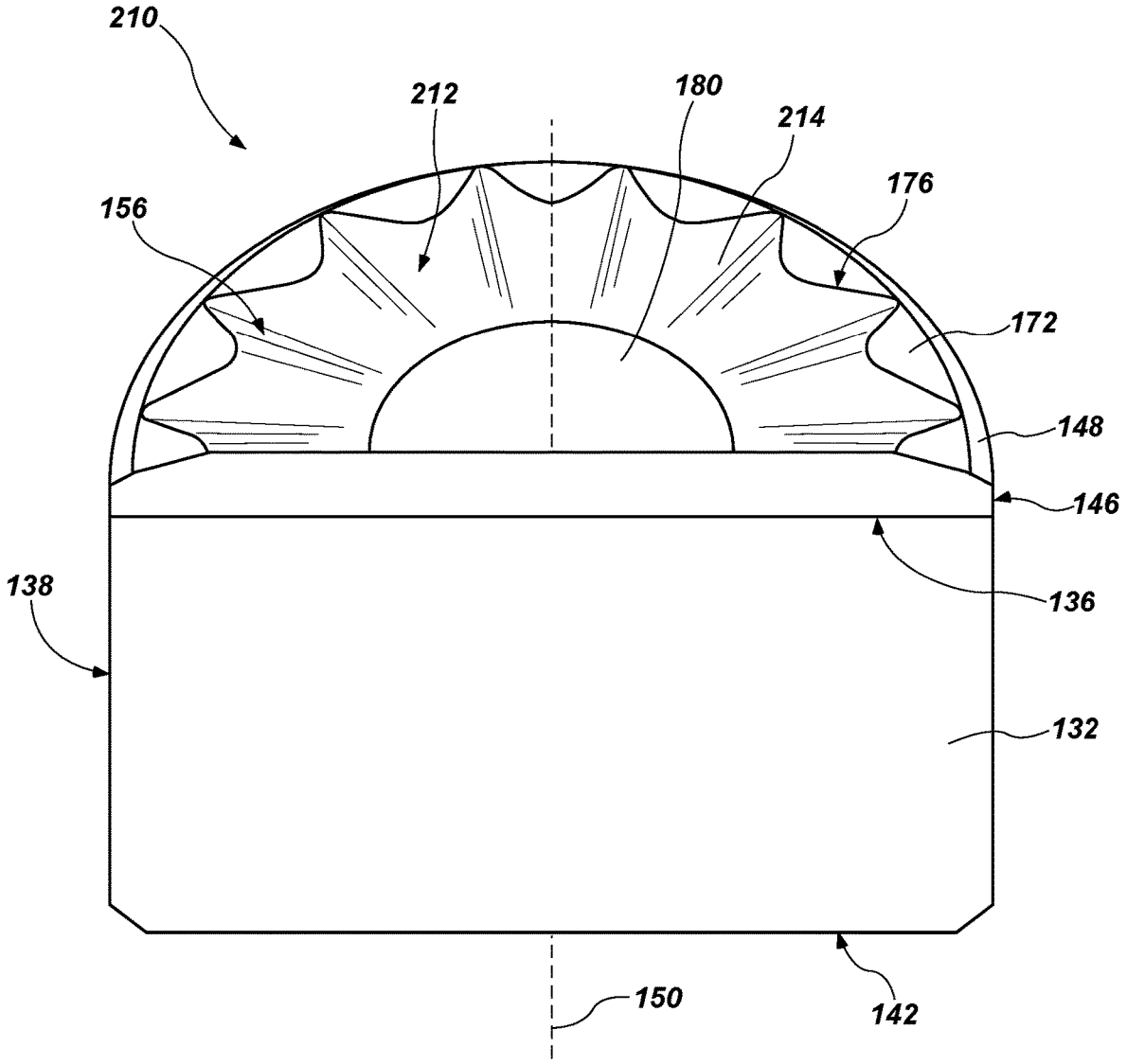
FIG. 7 is partial cutaway perspective view of still another embodiment of a cutting element usable with the earth-boring tool of FIG. 1.

FIG. 7 is partial cutaway perspective view of still another embodiment of a cutting element 210 usable with the earth-boring tool 100 of FIG. 1. In some embodiments, such as that shown in FIG. 7, a surface 212 of a waveform 214 may extend longitudinally from the undulating edge 176 away from the substrate 132, such that the surface 212 extends in a fourth direction oblique to the central axis 150. More specifically, the peaks of the waveform 214 may extend in a radial direction perpendicular to the central axis 150, and the troughs of the waveform 214 may extend in a radial direction oblique to the central axis 150, such that the depth of the troughs decreases as radial distance from the central axis 150 decreases.

Figure 8:
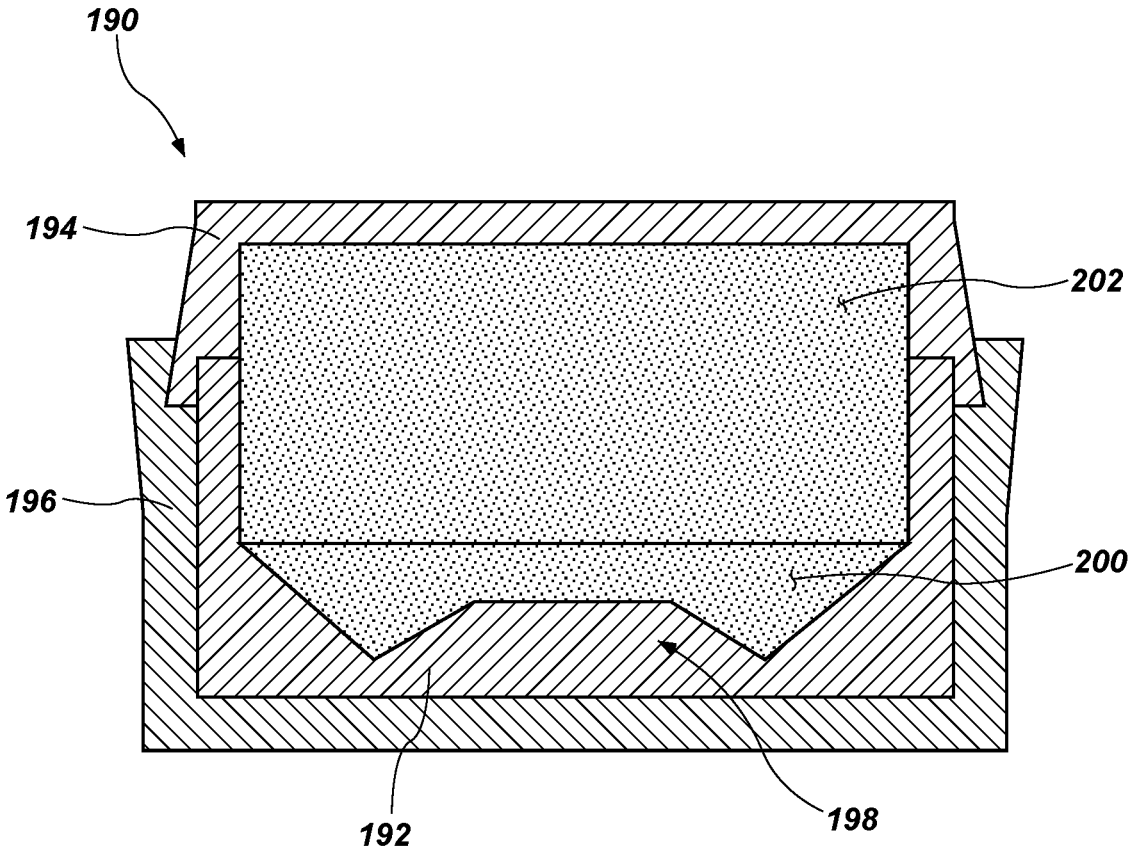
FIG. 8 is a cross-sectional side view of a container usable for forming cutting elements in accordance with this disclosure.

FIG. 8 is a cross-sectional side view of a container 190 usable for forming cutting elements 130, 160, and 170 in accordance with this disclosure. The container 190 may include an innermost cup-shaped member 192, a mating cup-shaped member 194, and an outermost cup-shaped member 196, which may be assembled and swaged and/or welded together to form the mold container 190. One or more of the cup-shaped members 192, 194, and 196 may include an inverse 198 of the curved, stress-reduction feature 156 to be formed on the second transition surface 152, 162, 172. For example, the innermost cup-shaped member 192 shown in FIG. 8 may include an inverse 198 of the waveform 174 shown in FIG. 6 or the waveform 214 shown in FIG. 7.

When forming the cutting element 130, 160, or 170, particles 200 of the superabrasive material may be positioned in the container 190 adjacent to the inverse 198. Catalyst material may be positioned in the container with the particles 200 of the superabrasive material, such as, for example, by intermixing particles of the catalyst material with the particles 200 of the superabrasive material or positioning a mass (e.g., a foil) of the catalyst material adjacent to the particles 200 of the superabrasive material. A preformed substrate or substrate precursor material or materials 202 may be positioned in the container 190 proximate the particles 200 of the superabrasive material. The container 190 may then be closed, and the entire assembly may be subjected to heat and pressure to sinter the particles 200 of the superabrasive material, forming the polycrystalline, superabrasive material 134 (see FIGS. 2-7) and securing it to the substrate 132 (see FIGS. 2-7).

As a result of the curved, stress-reduction features 156 shown herein, the stress, and particularly the occurrence of tensile stress, within the cutting elements 130, 160, 170, and 210 may be reduced. For example, the inventors have modeled the stresses experienced by at least one of the cutting elements 130, 160, 170, and 210, and the curved, stress-reduction features 156 may reduce the peak tensile stress within the cutting elements 130, 160, 170, and 210 by at least 15%. More specifically, the curved, stress-reduction features 156 may reduce the peak tensile stress by between about 15% and about 50%. As a specific, nonlimiting example, the curved, stress-reduction features 156 may reduce the peak tensile stress by between about 25% and about 45% (e.g., about 30%). It is expected that the others of the cutting elements 130, 160, 170, and 210 will perform similarly to, if not better than, the simulated results.

Additional, nonlimiting embodiments within the scope of this disclosure include the following:

Embodiment 1: A cutting element for an earth-boring tool, comprising: a substrate; and a polycrystalline, superabrasive material secured to an end of the substrate, the polycrystalline, superabrasive material comprising: a first transition surface extending in a direction oblique to a central axis of the substrate; a second transition surface extending in a second direction oblique to the central axis, the second direction being different from the first direction; and a curved, stress-reduction feature located on the second transition surface.

Embodiment 2: The cutting element of Embodiment 1, wherein the curved, stress-reduction feature comprises a radiusing of the second transition surface, such that a slope of the second transition surface changes continuously from the first transition surface to a cutting face of the polycrystalline, superabrasive material extending perpendicular to the central axis.

Embodiment 3: The cutting element of Embodiment 2, wherein a radius of curvature of the second transition surface is between 0.042 inch and 0.13 inch.

Embodiment 4: The cutting element of Embodiment 1, wherein the curved, stress-reduction feature comprises protrusions extending outward from the second transition surface.

Embodiment 5: The cutting element of Embodiment 4, wherein the protrusions are positioned in a repeating pattern around a circumference of the second transition surface at a frequency of between one every 90° and ten every 90°.

Embodiment 6: The cutting element of Embodiment 4 or Embodiment 5, wherein a perimeter of each protrusion as viewed in a plane at least substantially normal to the second transition surface at a geometrical center of a respective protrusion is circular.

Embodiment 7: The cutting element of Embodiment 1, wherein the curved, stress-reduction feature comprises a waveform extending around a circumference of the second transition surface.

Embodiment 8: The cutting element of Embodiment 7, wherein a surface of the waveform positioned to engage with an underlying earth formation and extending radially from the second transition surface toward the central axis is tapered toward the substrate.

Embodiment 9: The cutting element of Embodiment 8, wherein the surface of the waveform extends from the second transition surface to a planar surface of the polycrystalline, superabrasive material, the planar surface oriented perpendicular, and located proximate, to the central axis.

Embodiment 10: The cutting element of any one of Embodiments 7 through 9, wherein a frequency of the waveform is between one every 180° and ten every 90°.

Embodiment 11: The cutting element of any one of Embodiments 1 through 10, wherein a maximum thickness of the second transition surface as measured in a direction parallel to the central axis is between 0.01 inch and 0.05 inch.

Embodiment 12: An earth-boring tool, comprising: a body; and a cutting element secured to the body, the cutting element comprising: a substrate; and a polycrystalline, superabrasive material secured to an end of the substrate, the polycrystalline, superabrasive material comprising: a first transition surface extending in a direction oblique to a central axis of the substrate; a second transition surface extending in a second direction oblique to the central axis, the second direction being different from the first direction; and a curved, stress-reduction feature located on the second transition surface.

Embodiment 13: The cutting element of Embodiment 12, wherein the curved, stress-reduction feature comprises a radiusing of the second transition surface, such that a slope of the second transition surface changes continuously from the first transition surface to a cutting face of the polycrystalline, superabrasive material extending perpendicular to the central axis.

Embodiment 14: The cutting element of Embodiment 13, wherein a radius of curvature of the second transition surface is between 0.042 inch and 0.13 inch.

Embodiment 15: The cutting element of Embodiment 12, wherein the curved, stress-reduction feature comprises protrusions extending outward from the second transition surface.

Embodiment 16: The cutting element of Embodiment 15, wherein the protrusions are positioned in a repeating pattern around a circumference of the second transition surface at a frequency of between one every 90° and ten every 90°.

Embodiment 17: The cutting element of Embodiment 15 or Embodiment 16, wherein a perimeter of each protrusion as viewed in a plane at least substantially normal to the second transition surface at a geometrical center of a respective protrusion is circular.

Embodiment 18: The cutting element of Embodiment 12, wherein the curved, stress-reduction feature comprises a waveform extending around a circumference of the second transition surface.

Embodiment 19: The cutting element of Embodiment 18, wherein a surface of the waveform positioned to engage with an underlying earth formation and extending radially from the second transition surface toward the central axis is tapered toward the substrate.

Embodiment 20: The cutting element of Embodiment 19, wherein the surface of the waveform extends from the second transition surface to a planar surface of the polycrystalline, superabrasive material, the planar surface oriented perpendicular, and located proximate, to the central axis.

Embodiment 21: The cutting element of any one of Embodiments 18 through 20, wherein a frequency of the waveform is between one every 180° and ten every 90°.

Embodiment 22: The cutting element of any one of Embodiments 12 through 21, wherein a maximum thickness of the second transition surface as measured in a direction parallel to the central axis is between 0.01 inch and 0.05 inch.

Embodiment 23: A method of making a cutting element for an earth-boring tool, comprising: shaping a polycrystalline, superabrasive material to comprise: a first transition surface extending in a direction oblique to a central axis of the substrate; a second transition surface extending in a second direction oblique to the central axis, the second direction being different from the first direction; and a curved, stress-reduction feature located on the second transition surface; and securing the polycrystalline, superabrasive material to a substrate.

Embodiment 24: The method of Embodiment 23, wherein shaping the polycrystalline, superabrasive material comprises positioning a precursor material into a container exhibiting an inverse of a final shape of the polycrystalline, superabrasive material and sintering the precursor material to form the polycrystalline, superabrasive material.

Embodiment 25: The method of Embodiment 23 or Embodiment 24, wherein shaping the polycrystalline, superabrasive material to comprise the curved, stress-reduction feature comprises shaping the polycrystalline, superabrasive material to comprise a radiusing of the second transition surface, such that a slope of the second transition surface changes continuously from the first transition surface to a cutting face of the polycrystalline, superabrasive material extending perpendicular to the central axis.

Embodiment 26: The method of Embodiment 23 or Embodiment 24, wherein shaping the polycrystalline, superabrasive material to comprise the curved, stress-reduction feature comprises shaping the polycrystalline, superabrasive material to comprise protrusions extending outward from the second transition surface.

Embodiment 27: The method of Embodiment 23 or Embodiment 24, wherein shaping the polycrystalline, superabrasive material to comprise the curved, stress-reduction feature comprises shaping the polycrystalline, superabrasive material to comprise a waveform extending around a circumference of the second transition surface.

Embodiment 28: The method of Embodiment 27, shaping the polycrystalline, superabrasive material to comprise the waveform comprises tapering a surface of the waveform toward the substrate, the surface of the waveform positioned to engage with an underlying earth formation and extending radially from the second transition surface toward the central axis.

Embodiment 29: The method of Embodiment 28, wherein tapering the surface of the waveform comprises tapering the surface of the waveform to extend from the second transition surface to a planar cutting face of the polycrystalline, superabrasive material, the planar cutting face oriented perpendicular, and located proximate, to the central axis.

Embodiment 30: The method of any one of Embodiments 23 through 29, wherein shaping the polycrystalline, superabrasive material to comprise the second transition surface comprises rendering a maximum thickness of the second transition surface as measured in a direction parallel to the central axis between 0.01 inch and 0.05 inch.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may be made to produce embodiments within the scope of this disclosure, such as those specifically claimed, including legal equivalents. In addition, features from one disclosed embodiment may be combined with features of another disclosed embodiment while still being within the scope of this disclosure, as contemplated by the inventor.

What is claimed is:

1. A cutting element for an earth-boring tool, comprising:
- a polycrystalline, superabrasive material secured to an end of a substrate, the polycrystalline, superabrasive material comprising:
- a first transition surface located proximate to a periphery of the polycrystalline, superabrasive material, the first transition surface extending oblique to a central axis of the substrate;
- a second transition surface located adjacent to the first transition surface, the second transition surface extending oblique to the central axis; and
- a surface of a waveform extending around a circumference of the second transition surface, the surface of the waveform tapered toward the substrate and extending radially from the second transition surface toward the central axis, the surface of the waveform extending from the second transition surface to a planar surface of the polycrystalline, superabrasive material located at a same distance from the substrate as troughs of the waveform surface, the planar surface oriented perpendicular, and located proximate, to the central axis.

2. The cutting element of claim 1, wherein a frequency of the waveform is between one every 180° and ten every 90°.

3. The cutting element of claim 1, wherein a maximum thickness of the second transition surface as measured in a direction parallel to the central axis is between 0.01 inch and 0.05 inch.

4. The cutting element of claim 1, wherein the second transition surface is curved.

5. The cutting element of claim 1, wherein peaks of the waveform are positioned to contact an underlying earth formation before any other portion of the polycrystalline, superabrasive material.

6. The cutting element of claim 1, wherein a roughness of the planar surface is different from a roughness of other exposed surfaces of the polycrystalline, superabrasive material.

7. The cutting element of claim 6, wherein the planar surface is rougher than the other exposed surfaces of the polycrystalline, superabrasive material.

8. The cutting element of claim 1, wherein a diameter of the planar surface is between 10% and 50% of a maximum diameter of the polycrystalline, superabrasive material.

9. The cutting element of claim 1, wherein a shape of the second transition surface between the first transition surface and the waveform is sinusoidal.

10. The cutting element of claim 1, wherein the waveform is configured to reduce peak tensile stress within the polycrystalline, superabrasive material by between about 15% and about 50%.

11. An earth-boring tool, comprising:
- a body; and
- a cutting element secured to the body, the cutting element comprising:
- a polycrystalline, superabrasive material secured to an end of a substrate, the polycrystalline, superabrasive material comprising:
- a first transition surface located proximate to a periphery of the polycrystalline, superabrasive material, the first transition surface extending oblique to a central axis of the substrate;
- a second transition surface located adjacent to the first transition surface, the second transition surface extending oblique to the central axis; and
- a surface of a waveform extending around a circumference of the second transition surface, the surface of the waveform tapered toward the substrate and extending radially from the second transition surface toward the central axis, the surface of the waveform extending from the second transition surface to a planar surface of the polycrystalline, superabrasive material located at a same distance from the substrate as troughs of the waveform surface, the planar surface oriented perpendicular, and located proximate, to the central axis.

12. The earth-boring tool of claim 11, wherein a frequency of the waveform is between one every 180° and ten every 90°.

13. The earth-boring tool of claim 11, wherein a maximum thickness of the second transition surface as measured in a direction parallel to the central axis is between 0.01 inch and 0.05 inch.

14. The earth-boring tool of claim 11, wherein the second transition surface is curved.

15. The earth-boring tool of claim 11, wherein a roughness of the planar surface is different from a roughness of other exposed surfaces of the polycrystalline, superabrasive material.

16. The cutting element of claim 11, wherein a diameter of the planar surface is between 10% and 50% of a maximum diameter of the polycrystalline, superabrasive material.

17. A method of removing an earth formation, comprising:
- rotating a body of an earth-boring tool; and
- removing an earth material in contact with a polycrystalline, superabrasive material of a cutting element secured to the body, the polycrystalline, superabrasive material comprising:
- a first transition surface located proximate to a periphery of the polycrystalline, superabrasive material, the first transition surface extending oblique to a central axis of a substrate;
- a second transition surface located adjacent to the first transition surface, the second transition surface extending oblique to the central axis; and
- a waveform extending around a circumference of the second transition surface, a surface of the waveform tapered toward from the substrate and extending radially from the second transition surface toward the central axis, the surface of the waveform extending from the second transition surface to a planar surface of the polycrystalline located at a same distance from the substrate as troughs of the waveform surface, the planar surface oriented perpendicular, and located proximate, to the central axis.

18. The method of claim 17, wherein removing the earth material in contact with the polycrystalline, superabrasive material comprises contacting the earth material with peaks of the waveform before any other portion of the polycrystalline, superabrasive material.

19. The method of claim 17, further comprising mitigating tensile stress within the polycrystalline, superabrasive material utilizing the waveform.

20. The method of claim 17, further comprising breaking a chip of the earth material when the earth material reaches an intersection between the waveform and the planar surface.

* * * * *